US007814873B2

(12) United States Patent
Tateno et al.

(10) Patent No.: US 7,814,873 B2
(45) Date of Patent: Oct. 19, 2010

(54) VARIABLE VALVE OPERATING DEVICE AND VALVE OPENING AMOUNT ADJUSTMENT METHOD

(75) Inventors: Manabu Tateno, Sunto-gun (JP); Shuichi Ezaki, Susono (JP); Toshiyuki Maehara, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 472 days.

(21) Appl. No.: 11/988,487

(22) PCT Filed: Sep. 22, 2006

(86) PCT No.: PCT/JP2006/318808

§ 371 (c)(1),
(2), (4) Date: Jan. 9, 2008

(87) PCT Pub. No.: WO2007/037172

PCT Pub. Date: Apr. 5, 2007

(65) Prior Publication Data

US 2009/0277408 A1 Nov. 12, 2009

(30) Foreign Application Priority Data

Sep. 27, 2005 (JP) ..... 2005-280185

(51) Int. Cl.
*F01L 1/34* (2006.01)

(52) U.S. Cl. ..... 123/90.16; 123/90.17; 123/90.39; 123/345; 74/569

(58) Field of Classification Search ..... 123/90.12, 123/90.13, 90.15, 90.16, 90.17, 90.18, 90.27, 123/90.31, 90.39, 90.44, 345, 346, 347, 348; 74/559, 567, 569

See application file for complete search history.

(56) References Cited

U.S. PATENT DOCUMENTS 6,769,387 B2 * 8/2004 Hayman et al. ..... 123/90.39

FOREIGN PATENT DOCUMENTS

| | | |
|---|---|---|
| JP | U 58-90306 | 6/1983 |
| JP | U 63-69730 | 5/1988 |
| JP | A 2001-329907 | 11/2001 |
| JP | A 2003-161118 | 6/2003 |
| JP | A 2004-100555 | 4/2004 |

* cited by examiner

*Primary Examiner*—Ching Chang
(74) *Attorney, Agent, or Firm*—Oliff & Berridge, PLC

(57) ABSTRACT

The present invention relates to a variable valve operating device and a valve opening amount adjustment method, and can accurately control the amount of in-cylinder air and the strength of a swirl flow. The variable valve operating device according to the present invention includes a valve mechanism that can select a dual valve variable control mode in which the valve opening amounts of a first valve and a second valve, which are of the same type and provided for the same cylinder, can be varied continuously or in multiple steps. A valve opening amount difference is provided when the valve opening amounts are minimized in the dual valve variable control mode so that the valve opening amount of the first valve is larger than that of the second valve. In addition, adjustments are made so that the minimum valve opening amount of the first valve does not vary from one cylinder to another.

9 Claims, 8 Drawing Sheets

VARIABLE VALVE OPERATING DEVICE AND VALVE OPENING AMOUNT ADJUSTMENT METHOD

TECHNICAL FIELD

The present invention relates to a variable valve operating device that is capable of varying the opening amount of a valve provided for a cylinder of an internal combustion engine. The present invention also relates to a method for adjusting the opening amount of the valve.

BACKGROUND ART

It is known that a conventional variable valve operating device described, for instance, in Patent Document 1 mechanically changes the operating angle and lift amount of a valve in accordance with the operating state of an internal combustion engine.

In the variable valve operating device described in Patent Document 1, two rotary cams are installed over a camshaft. Two intake valves are provided for a single cylinder. A first intake valve is opened and closed by a first rotary cam. A second intake valve is opened and closed by a second rotary cam. A variable valve transmission mechanism, which includes a four-joint link mechanism, is positioned between the first rotary cam and the first intake valve and between the second rotary cam and the second intake valve.

The above variable valve operating device can continuously vary the lift amount of the two intake valves. Therefore, an internal combustion engine having the above variable valve operating device can conduct a so-called non-throttle operation in which the intake air amount is controlled in accordance with changes in the intake valve lift amount without using a throttle valve.

Further, the above variable valve operating device includes a switching mechanism that uses a coupling pin to couple the four-joint link mechanism for the first intake valve to the four-joint link mechanism for the second intake valve or uncouple them from each other. The switching mechanism can select either a dual valve variable control mode or a single valve variable control mode. In the dual valve variable control mode, the lift amounts of the first and second intake valves are simultaneously varied. In the single valve variable control mode, on the other hand, the lift amount of only the first intake valve is varied while a large lift amount is constantly provided for the second intake valve.

The above variable valve operating device can exercise swirl control to create a swirl flow in a combustion chamber in the single valve variable control mode in which the lift amount of the first intake valve differs from that of the second intake valve so that the first and second intake valves differ in the air flow rate. A swirl flow in the combustion chamber brings about combustion improvement, for instance, in a low-load condition.

Patent Document 1: Japanese Patent Laid-open No. 2004-100555

DISCLOSURE OF INVENTION

Problem to be Solved by the Invention

In a situation where the amount of air is to be controlled while the intake valve lift amount is variable, the amount of air does not significantly change during the use of a great lift amount no matter whether the lift amount slightly changes. During the use of a small lift amount, however, the amount of air is greatly affected by the slightest change in the lift amount. When the aforementioned non-throttle operation or swirl control is to be performed, either or both of the intake valves are set for a small lift. Therefore, in a situation where the non-throttle operation or swirl control is performed, the intake air amount or the strength of a swirl flow are likely to change greatly even when the intake valve lift amount changes slightly. Consequently, when the non-throttle operation or swirl control is to be performed, it is necessary to exercise precise lift amount control. In this respect, the conventional technology described above still needs improvement.

The present invention has been made to solve the above problem. An object of the present invention is to provide a variable valve operating device and valve opening amount adjustment method for precisely controlling the amount of in-cylinder air and the strength of a swirl flow.

ADVANTAGES OF THE INVENTION

Means for Solving the Problem

First aspect of the present invention is an variable valve operating device comprising:

a valve mechanism that can select a dual valve variable control mode in which the valve opening amounts of a first valve and a second valve can be varied continuously or in multiple steps, the first and the second valve being of the same type and provided for each cylinder in a multi-cylinder internal combustion engine, wherein a valve opening amount difference is provided so that the valve opening amount of the first valve for each cylinder is larger than the valve opening amount of the second valve when the valve opening amounts are minimized in the dual valve variable control mode; and wherein adjustments are made so that the minimum valve opening amount of the first valve does not vary from one cylinder to another.

Second aspect of the present invention is the variable valve operating device according to the first aspect, wherein the second valve is not adjusted to provide the same valve opening amount for all cylinders.

Third aspect of the present invention is the variable valve operating device according to the first or the second aspect, wherein the valve mechanism can switch between the dual valve variable control mode and a single valve variable control mode in which the valve opening amount of the first valve can be varied continuously or in multiple steps while the valve opening amount of the second valve is fixed at a predetermined value. Fourth aspect of the present invention is the variable valve operating device according to any one of the first to the third aspects, further comprising:

an adjustment mechanism for simultaneously adjusting the valve opening amounts of the first valve and the second valve in the dual valve variable control mode, wherein the adjustment mechanism makes adjustments so that the minimum valve opening amount of the first valve does not vary from one cylinder to another.

Fifth aspect of the present invention is a variable valve operating device comprising:

a valve mechanism that can switch between a dual valve variable control mode in which the valve opening amounts of a first valve and a second valve, which are of the same type and provided for the same cylinder, can be varied continuously or in multiple steps, and a single valve variable control mode in which the valve opening amount of the first valve can be varied continuously or in multiple steps while the valve opening amount of the second valve is fixed at a predetermined value, wherein a valve opening amount difference is provided so that the valve opening amount of the first valve is larger than the valve opening amount of the second valve when the valve opening amounts are minimized in the dual valve variable control mode.

Sixth aspect of the present invention is the variable valve operating device according to the fifth aspect, further comprising:

a first swing cam arm that swings in synchronism with camshaft rotation and has a cam surface for pressing the first valve directly or indirectly; and a second swing cam arm that swings in synchronism with camshaft rotation and has a cam surface for pressing the second valve directly or indirectly;

wherein the valve opening amount difference is provided by shifting the phase of the cam surface profile of the second swing cam arm toward a small valve opening side while allowing the cam surface profile of the second swing cam arm to have the same shape as the cam surface profile of the first swing cam arm.

Seventh aspect of the present invention is the variable valve operating device according to the fifth aspect, further comprising:

a pushing force transmission mechanism having a first transmission member and a second transmission member, which transmit a cam's pushing force to the first valve and the second valve, respectively, wherein the valve opening amount difference is provided by shifting the range of dimensional tolerance of the second transmission member toward the small valve opening side while allowing the second transmission member to have the same dimensional tolerance width as the first transmission member.

Eighth aspect of the present invention is the variable valve operating device according to any one of the fifth to the seventh aspects, further comprising:

an adjustment mechanism for simultaneously adjusting the valve opening amounts of the first valve and the second valve in the dual valve variable control mode while maintaining the ratio between the valve opening amounts of the first and second valves.

Ninth aspect of the present invention is a valve opening amount adjustment method for adjusting the valve opening amounts of valves in a multi-cylinder internal combustion engine having the variable valve operating device according to any one of the fifth to the eighth aspects, the valve opening amount adjustment method comprising the step of:

adjusting the valve opening amounts of cylinders so that the minimum valve opening amount of the first valve does not vary from one cylinder to another.

Effects of the Invention

According to the first aspect of the present invention, the first valve can have a larger opening than the second valve while the valve opening amounts are minimized in the dual valve variable control mode. Therefore, when the valve opening amounts are small in the dual valve variable control mode, a small amount of air flows through the second valve, which has a smaller opening than the first valve. Consequently, the amount of in-cylinder air is mainly governed by the valve opening amount of the first valve. Further, since the first aspect of the present invention can provide all cylinders with the same valve opening amount of the first valve, the cylinder-to-cylinder variation in in-cylinder air amount can be sufficiently suppressed. This makes it possible to have all cylinders generate the same torque, thereby effectively avoiding torque variation and other problems arising out of cylinder-to-cylinder torque variation. Furthermore, the first aspect of the present invention can adjust the valve opening amount of each cylinder simply by providing the first valves of all cylinders with the same valve opening amount. The adjustment of the second valve may be simplified or skipped. As a result, the time required for valve opening amount adjustment can be reduced.

According to the second aspect of the present invention, the second valve need not always be adjusted to provide all cylinders with the same valve opening amount. The reason is that the valve opening amounts of the second valves need not precisely be equal for all cylinders because the amount of in-cylinder air is governed by the valve opening amount of the first valve. Consequently, the second aspect of the present invention makes it possible to simplify valve opening amount adjustments and reduce the cost.

According to the third aspect of the present invention, it is possible to switch between the dual valve variable control mode and the single valve variable control mode in which the valve opening amount of the first valve is variable while the valve opening amount of the second valve is fixed. In the single valve variable control mode, the valve opening amount of the first valve can be made smaller than that of the second valve to create an in-cylinder swirl flow. In this instance, the strength of the swirl flow is mainly governed by the valve opening amount of the first valve, which provides a small valve opening amount. According to the third aspect of the present invention, the valve opening amount of the first valve is more influential over the in-cylinder state than that of the second valve no matter whether the dual valve variable control mode or single valve variable control mode is selected. Consequently, the third aspect of the present invention makes it possible to accurately adjust the amount of air in each cylinder and the strength of the swirl flow without regard to operating conditions by controlling the valve opening amount of the first valve.

According to the fourth aspect of the present invention, the minimum valve opening amounts of the first valves for all cylinders can be equalized with the adjustment mechanism, which simultaneously adjusts the valve opening amounts of the first and second valves in the dual valve variable control mode. This eliminates the necessity of separately adjusting the valve opening amounts of the first and second valves, thereby reducing the time required for adjustments.

According to the fifth aspect of the present invention, the first valve can have a larger opening than the second valve while the valve opening amounts are minimized in the dual valve variable control mode. Therefore, when a small valve opening amount is used in the dual valve variable control mode, a small amount of air flows through the second valve, which has a smaller valve opening than the first valve. Consequently, the amount of in-cylinder air is governed by the valve opening amount of the first valve. In the single valve variable control mode, on the other hand, a swirl flow can be created in a cylinder by making the valve opening amount of the first valve smaller than that of the second valve. In such an instance, the strength of the swirl flow is mainly governed by the valve opening amount of the first valve, which has a small valve opening. That is to say, according to the fifth aspect of the present invention, the valve opening amount of the first valve is more influential over the in-cylinder state than that of the second valve no matter whether the dual valve variable control mode or single valve variable control mode is selected. Consequently, the fifth aspect of the present invention makes it possible to accurately control the amount of in-cylinder air and the strength of the swirl flow without regard to operating conditions by controlling the valve opening amount of the first valve.

According to the sixth aspect of the present invention, the valve opening amount of the first valve can be made different from that of the second valve in the dual valve variable control mode simply by shifting the phase of the cam surface profile of the second swing cam arm toward the small valve opening side while allowing the cam surface profile of the second swing cam arm to have the same shape as the cam surface profile of the first swing cam arm. Since both cam surfaces are of the same shape according to the sixth aspect of the present invention, it is possible to accomplish machining with ease and avoid an increase in the manufacturing cost.

According to the seventh aspect of the present invention, the valve opening amount of the first valve can be made different from that of the second valve in the dual valve variable control mode simply by shifting the range of dimensional tolerance of the second transmission member toward the small valve opening side while allowing the second transmission member to have the same dimensional tolerance width as the first transmission member. Since the first and second transmission members have the same dimensional tolerance width while their dimensional tolerance ranges are shifted from each other according to the seventh aspect of the present invention, both members may be machined to the same accuracy. This makes it possible to accomplish machining with ease and avoid an increase in the manufacturing cost.

According to the eighth aspect of the present invention, the valve opening amounts of the first and second valves in the dual valve variable control mode can be simultaneously adjusted with their ratio maintained constant. This makes it possible to easily correct an error in the valve opening amount due, for instance, to component part tolerance variations or assembling accuracy and adjust the valve opening amount for a target design value. Further, the eighth aspect of the present invention makes it possible to simultaneously adjust the valve opening amounts of the first and second valves without changing the magnitude relationship between them. This eliminates the necessity of separately adjusting the valve opening amounts of the first and second valves, thereby reducing the time required for adjustments.

According to the ninth aspect of the present invention, the minimum valve opening amounts of the first valves for all cylinders can be equalized when valve opening amount adjustments are to be made for a multi-cylinder internal combustion engine having the variable valve operating device according to the present invention. The amount of in-cylinder air and the strength of a swirl flow are mainly governed by the valve opening amount of the first valve no matter whether the dual valve variable control mode or single valve variable control mode is selected. The amount of in-cylinder air and the strength of a swirl flow are important factors that determine the combustion state of a cylinder and the torque generated by the cylinder. While the valve opening amounts of the first valves for all cylinders are equal, it is possible to avoid a cylinder-to-cylinder variation in in-cylinder air amount and swirl flow strength no matter whether the dual or single valve variable control mode is selected, and have all cylinders generate the same torque. As a result, the ninth aspect of the present invention makes it possible to effectively reduce the occurrence of a problem such as torque variation caused by cylinder-to-cylinder torque variation.

DESCRIPTION OF REFERENCE NUMERALS

Best Mode for Carrying Out the Invention

First Embodiment

[Configuration of Variable Valve Operating Device]

Figure 1:
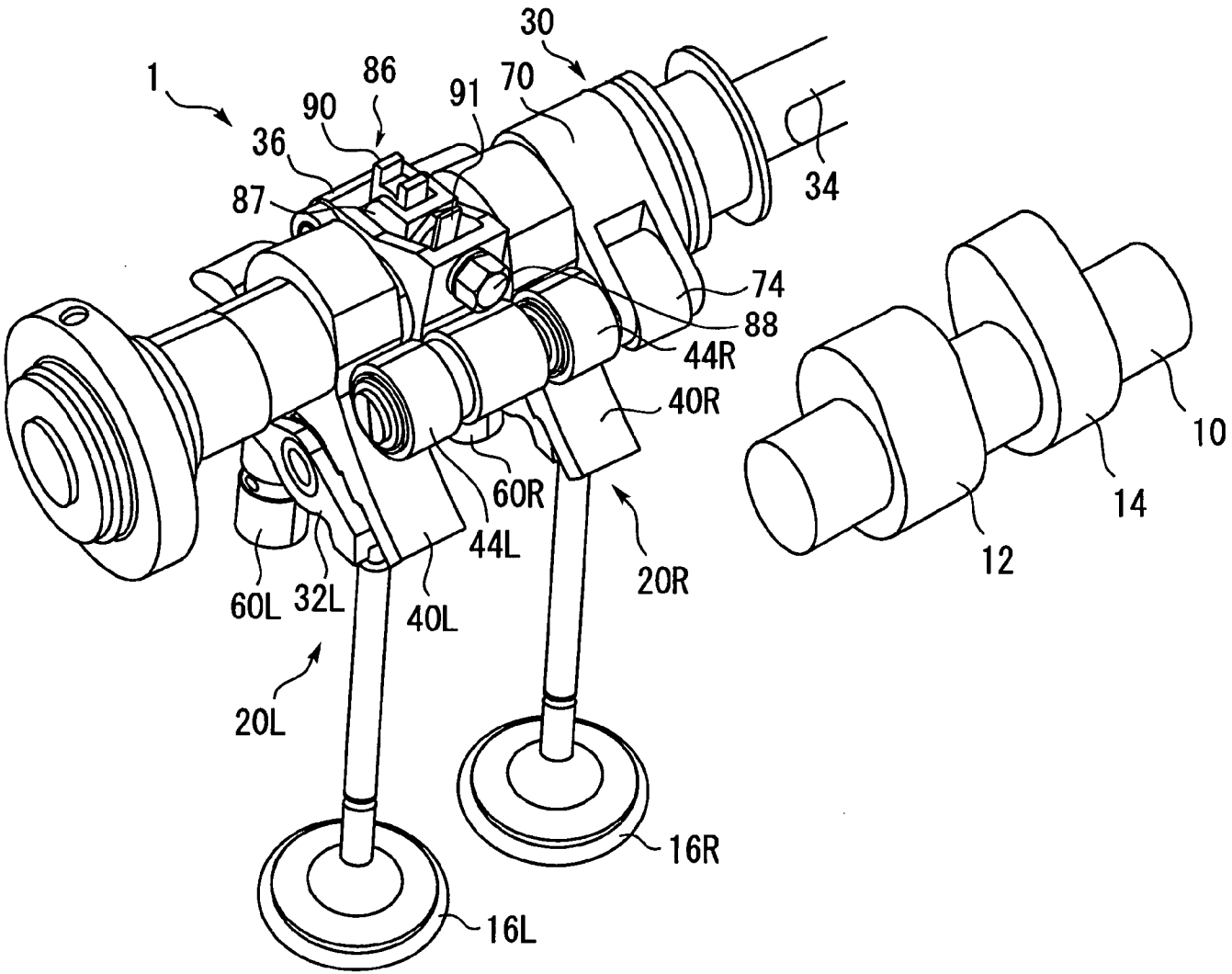
FIG. 1 is a perspective view illustrating a variable valve operating device according to a first embodiment of the present invention.

FIG. 1 is a perspective view illustrating a variable valve operating device according to a first embodiment of the present invention. The variable valve operating device 1 shown in FIG. 1 drives a first valve 16L and a second valve 16R, which are two intake valves provided for each cylinder of a multi-cylinder internal combustion engine. A camshaft 10 of the variable valve operating device 1 is provided with two drive cams 12, 14. These two drive cams 12, 14 are provided for each cylinder. The first valve 16L and the second valve 16R are symmetrically positioned on the right- and left-hand sides of one drive cam (first drive cam) 12. Variable valve mechanisms 20L, 20R are positioned between the first drive cam 12 and the first valve 16L or between the first drive cam 12 and the second valve 16R. The variable valve mechanisms 20L, 20R coordinate the lifting motions of the first and second valves 16L, 16R with the rotary motion of the first drive cam 12.

The remaining drive cam (second drive cam 14) is positioned so that the second valve 16R is sandwiched between the first drive cam 12 and the second drive cam 14. A fixed valve mechanism 30 is positioned between the second drive cam 14 and the second valve 16R to coordinate the lifting motion of the second valve 16R with the rotary motion of the second drive cam 14. The variable valve operating device 1 can choose either the variable valve mechanism 20R or the fixed valve mechanism 30 as a coordination destination for the lifting motion of the second valve 16R.

(Detailed Configurations of Variable Valve Mechanisms)

Figure 2:
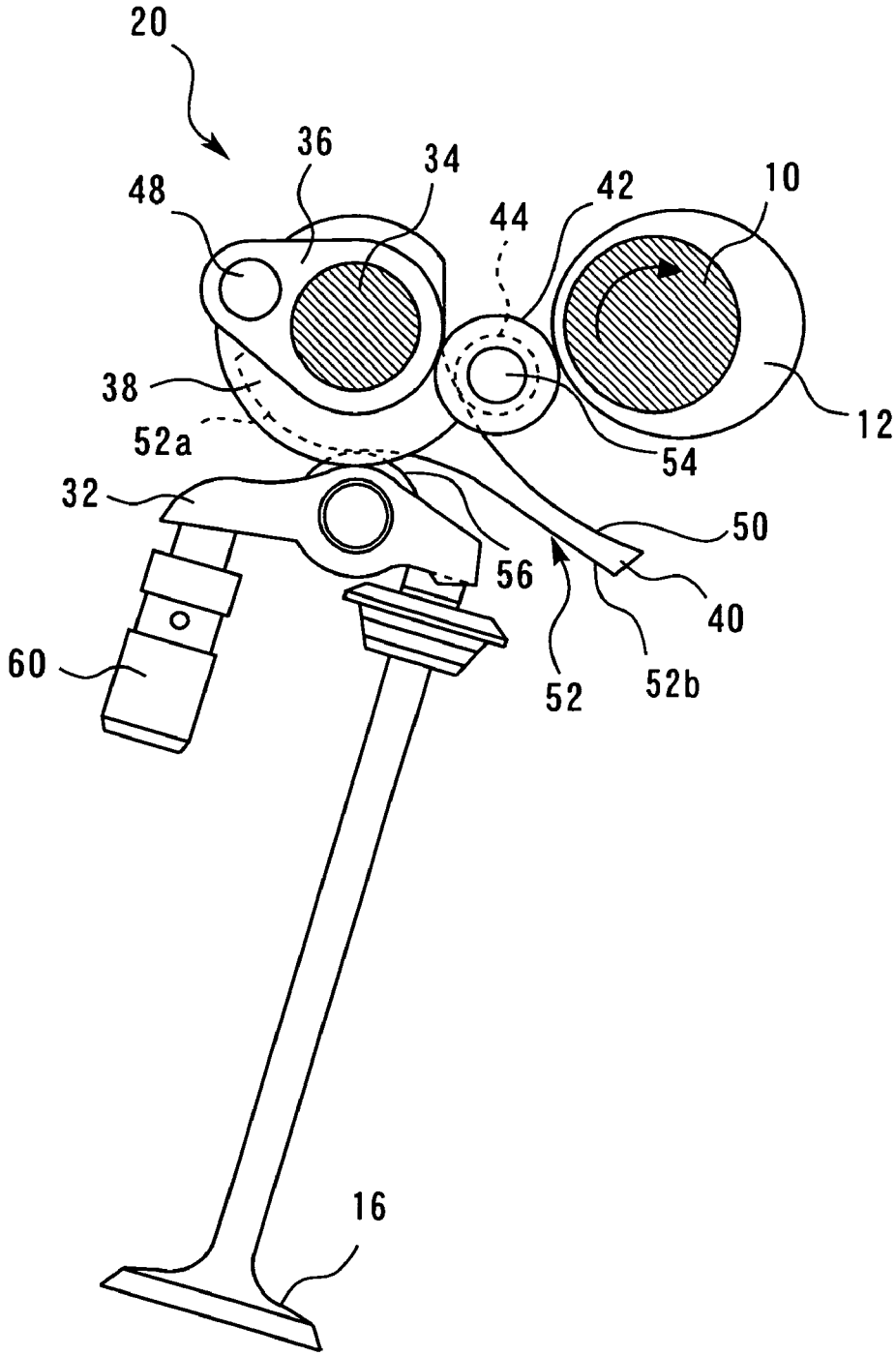
FIG. 2 is a side view that illustrates a variable valve mechanism according to the first embodiment of the present invention in a situation where the valve opening amount is large.

First of all, the configurations of the variable valve mechanisms 20L, 20R will be described in detail with reference to FIG. 2. FIG. 2 is a view of a variable valve mechanism 20 shown in FIG. 1 that is obtained when it is viewed in axial direction of the camshaft 10. The left- and right-hand variable valve mechanisms 20L, 20R are basically symmetrical with respect to the first drive cam 12. Therefore, the configuration of the variable valve mechanisms will be described without distinguishing between the left- and right-hand variable valve mechanisms 20L, 20R. In this document and in the accompanying drawings, the term "variable valve mechanism 20" is representatively used when there is no need to distinguish between the left- and right-hand variable valve mechanisms 20L, 20R. The same also holds true for component parts of the variable valve mechanisms 20L, 20R. Further, the first valve 16L and the second valve 16R will be simply referred to as the "valve 16" when there is no need to distinguish between the two.

As shown in FIG. 2, the variable valve operating device 1 includes a rocker arm 32, which opens the valve 16 by pressing it. The variable valve mechanism 20 is positioned between the first drive cam 12 and rocker arm 32 to continuously vary the coordination between the rotary motion of the first drive cam 12 and the swing motion of the rocker arm 32.

As described below, the main component members of the variable valve mechanism 20 are a control shaft 34, a control arm 36, a link arm 38, a swing cam arm 40, a first roller 42, and a second roller 44. The control shaft 34 is positioned in parallel with the camshaft 10. The rotation angle of the control shaft 34 can be controlled as appropriate by a motor or other actuator (not shown).

The control arm 36 is fastened to the control shaft 34 and pivots together with the control shaft 34. The control arm 36 is projected in the radial direction of the control shaft 34. The arch-shaped link arm 38 is mounted on the projection of the control arm 36. The rear end of the link arm 38 is rotatably coupled to the control arm 36 with a pin 48. The pin 48 is positioned eccentrically relative to the center of the control shaft 34 and used as a fulcrum on which the link arm 38 swings.

The swing cam arm 40 is swingably supported by the control shaft 34. The leading end of the swing cam arm 40 is oriented upstream in the rotation direction of the first drive cam 12. A slide surface 50, which comes into contact with the second roller 44, is formed on a portion of the swing cam arm 40 that faces the first drive cam 12. The slide surface 50 has a curved surface so that its distance to the first drive cam 12 gradually decreases when the second roller 44 moves away from the leading end of the swing cam arm 40 and toward the axial center of the control shaft 34. Further, a swing cam surface 52 is formed opposite the slide surface 50. The swing cam surface 52 includes a nonoperating surface 52*a* and an operating surface 52*b*. The nonoperating surface 52*a* is formed so that its distance from the swing center of the swing cam arm 40 is fixed. The operating surface 52*b* is formed so that its distance from the axial center of the control shaft 34 increases with an increase in the distance to the nonoperating surface 52*a*.

The first roller 42 and the second roller 44 are positioned between the slide surface 50 of the swing cam arm 40 and the circumferential surface of the first drive cam 12. More specifically, the first roller 42 is positioned so as to come into contact with the circumferential surface of the first drive cam 12, whereas the second roller 44 is positioned so as to come into contact with the slide surface 50 of the swing cam arm 40. The first and second rollers 42, 44 are both rotatably supported by a coupling shaft 54 that is fastened to the leading end of the aforementioned link arm 38. Since the link arm 38 can swing on the pin 48, these rollers 42, 44 can swing along the slide surface 50 and the circumferential surface of the first drive cam 12 while maintaining a fixed distance to the pin 48.

Further, a lost motion spring (not shown) is engaged with the swing cam arm 40. The force of the lost motion spring causes the slide surface 50 to press the second roller 44 and presses the first roller 42 against the first drive cam 12. The first and second rollers 42, 44 are then sandwiched between the slide surface 50 and the circumferential surface of the first drive cam 12 for positioning purposes.

The aforementioned rocker arm 32 is positioned below the swing cam arm 40. A rocker roller 56 is attached to the rocker arm 32 in such a manner that the rocker roller 56 faces the swing cam surface 52. The rocker roller 56 is rotatably mounted on an intermediate portion of the rocker arm 32. One end of the rocker arm 32 abuts against the end of a valve stem of the valve 16. The other end of the rocker arm 32 is supported by a hydraulic lash adjuster 60. When a lifting operation is conducted, a valve spring (not shown) pushes the valve 16 in a closing direction, that is, in a direction of pushing up the rocker arm 32. In addition, the rocker roller 56 is pressed against the swing cam surface 52 of the swing cam arm 40 by the force of the valve spring and by the hydraulic lash adjuster 60.

According to the configuration of the variable valve mechanism 20 described above, the pushing force of the first drive cam 12 is transmitted to the slide surface 50 via the first and second rollers 42, 44 as the first drive cam 12 rotates. The swing cam arm 40 then pivots on the control shaft 34 and moves downward in the figure. When the contact between the swing cam surface 52 and rocker roller 56 moves from the nonoperating surface 52*a* to the operating surface 52*b* due to the pivot of the swing cam arm 40, the rocker arm 32 is pushed downward to open the valve 16.

The variable valve mechanism 20 shown in FIG. 2 is in a state in which the maximum operating angle and lift amount are obtained. When the control shaft 34 rotates counterclockwise in the figure, the operating angle and lift amount continuously decrease in accordance with the amount of control shaft rotation. The variable valve mechanism 20 shown in FIG. 3 is in a state in which a small operating angle and lift amount are obtained.

The variable valve mechanism 20 according to the present embodiment can vary the operating angle and lift amount simultaneously and continuously. In this document, the operating angle and lift amount are collectively referred to as a "valve opening amount." It should be noted, however, that the variable valve operating device according to the present invention is not limited to the configuration for simultaneously varying the operating angle and lift amount. Alternatively, the variable valve operating device may be configured to continuously vary either the operating angle or the lift amount.

Figure 3:
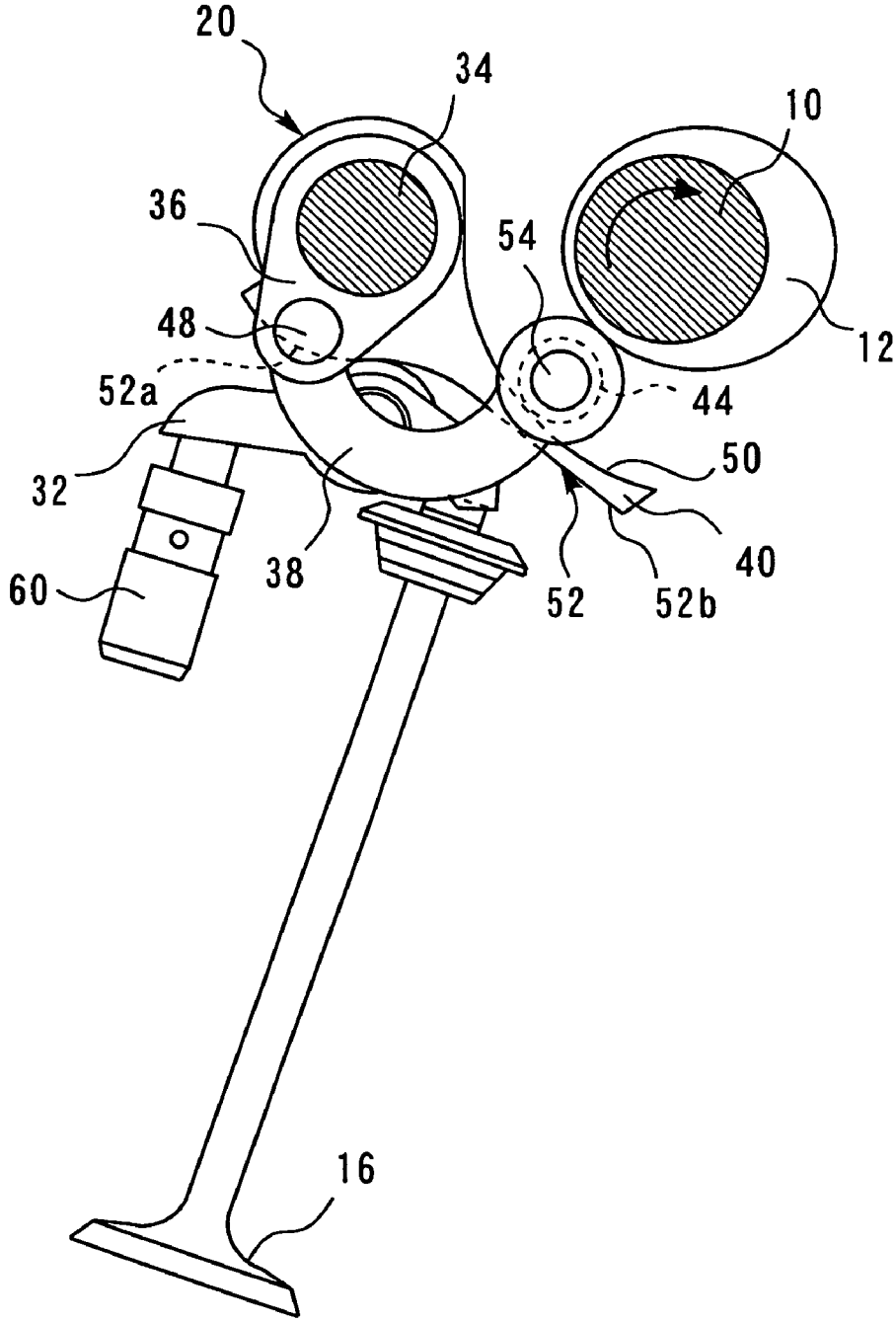
FIG. 3 is a side view that illustrates the variable valve mechanism according to the first embodiment of the present invention in a situation where the valve opening amount is small.

When the control shaft 34 shown in FIG. 2 rotates counterclockwise in the figure, the position of the second roller 44 on the slide surface 50 moves toward the leading end of the swing cam arm 40 as shown in FIG. 3. This reduces the amplitude at which the swing cam arm 40 swings. Further, the slide surface 50 is curved, as mentioned earlier, so that the distance to the first drive cam 12 decreases with a decrease in the distance to the leading end of the swing cam arm 40. In the state shown in FIG. 3, therefore, the swing cam arm 40 begins swinging at a position that is reached after counterclockwise rotation in the figure, as compared to a state where the valve opening amount is large. In the state shown in FIG. 3, therefore, the contact between the rocker roller 56 and swing cam surface 52 moves from the nonoperating surface 52*a* to the operating surface 52*b* with delayed timing after the swing cam arm 40 starts swinging. This phenomenon and the decrease in the amplitude of the swing cam arm 40 provide the valve 16 in the state shown in FIG. 3 with a valve opening amount smaller than indicated in FIG. 2.

In a state where the valve opening amount is small as indicated in FIG. 3, the second roller 44 moves upstream in the rotation direction of the first drive cam 12 as compared to a state where the valve opening amount is large as indicated in FIG. 2. Therefore, the swing start of the swing cam arm 40 in the state shown in FIG. 3 is timed earlier than in the state shown in FIG. 2. Meanwhile, the move of the contact between the rocker roller 56 and swing cam surface 52 from the nonoperating surface 52*a* to the operating surface 52*b* after the swing start of the swing cam arm 40 takes place later in the state shown in FIG. 3 than in the state shown in FIG. 2 as mentioned earlier. Even when the valve opening amount is varied, the variable valve mechanism 20 allows these two timing changes to offset each other and causes the valve 16 to start opening with fixed timing.

(Detailed Configuration of Fixed Valve Mechanism)

The configuration of the fixed valve mechanism 30 will now be described in detail with reference to FIGS. 1 and 4.

As shown in FIG. 1, the fixed valve mechanism 30 is positioned between the second drive cam 14 and a second swing cam arm 40R. The fixed valve mechanism 30 coordinates the swing motion of the second swing cam arm 40R with the rotary motion of the second drive cam 14, and includes a great lift arm 70, which is driven by the second drive cam 14, and an arm coupling mechanism 72 (see FIG. 4), which couples the great lift arm 70 to the second swing cam arm 40R.

The great lift arm 70 is installed over the control shaft 34, positioned alongside of the second swing cam arm 40R, and capable of swinging independently of the second swing cam arm 40R. An input roller 74, which comes into contact with the circumferential surface of the second drive cam 14, is rotatably supported by the great lift arm 70. A lost motion spring (not shown) is engaged with the great lift arm 70. The force of the spring presses the input roller 74 against the circumferential surface of the second drive cam 14. The great lift arm 70 is driven by the second drive cam 14 to swing at the same amplitude as the swing cam arm 40 in a large valve opening state.

Figure 4:
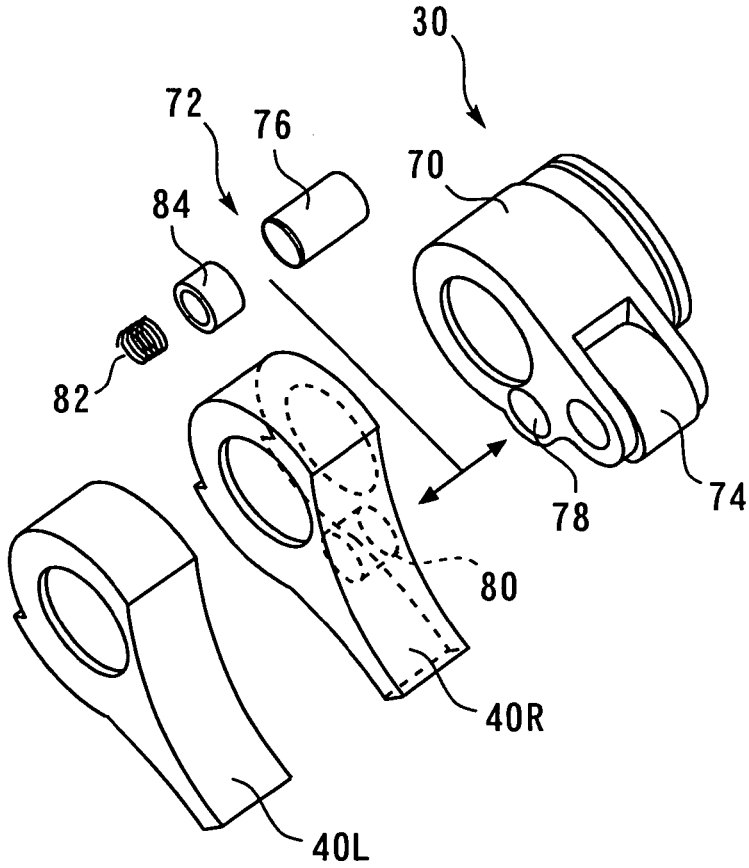
FIG. 4 is an exploded perspective view illustrating a first swing cam arm, a second swing cam arm, and a great lift arm.

FIG. 4 is an exploded perspective view illustrating a first swing cam arm 40L, the second swing cam arm 40R, and the great lift arm 70. As shown in FIG. 4, the great lift arm 70 is provided with a pin 76 that can be insert into and extracted from the second swing cam arm 40R. A hydraulic chamber 78 is formed in the great lift arm 70. The hydraulic chamber 78 has an opening that is positioned toward the second swing cam arm 40R. The pin 76 is lodged in the hydraulic chamber 78. Hydraulic fluid is supplied to the hydraulic chamber 78 through a hydraulic path (not shown). When the hydraulic pressure in the hydraulic chamber 78 increases, the configuration described above allows the hydraulic pressure to extract the pin 76 from the hydraulic chamber 78 and pushes it out toward the second swing cam arm 40R.

Meanwhile, a pin hole 80 is formed in the second swing cam arm 40R. The pin hole 80 has an opening that is positioned toward the great lift arm 70. The pin 76 and pin hole 80 are positioned on an arc that is centered on the control shaft 34. This ensures that the pin hole 80 aligns with the pin 76 when the second swing cam arm 40R is positioned at a predetermined rotation angle relative to the great lift arm 70. From bottom to top, items placed in the pin hole 80 are a return spring 82 and a piston 84.

When the pin hole 80 aligns with the pin 76, the configuration described above brings the pin 76 into contact with the piston 84. If, in this instance, the force exerted by the hydraulic pressure within the hydraulic chamber 78 to press the pin 76 is greater than the force exerted by the return spring 82 to press the piston 84, the pin 76 enters the pin hole 80 while pushing the piston 84 toward the bottom of the pin hole 80. When the pin 76 is inserted into the pin hole 80, the swing cam arm 40R is coupled to the great lift arm 70 via the pin 76. In other words, the pin 76, the hydraulic chamber 78 to which hydraulic fluid is supplied, the pin hole 80, the return spring 82, and the piston 84 constitute the arm coupling mechanism 72.

In the variable valve operating device 1, the pin 76 aligns with the pin hole 80 when the swing cam arm 40R is placed at a predetermined rotation angle relative to the great lift arm 70. When the pin 76 aligns with the pin hole 80, the pin 76 goes into the pin hole 80, thereby coupling the great lift arm 70 to the second swing cam arm 40R. When the arm coupling mechanism 72 couples the great lift arm 70 to the second swing cam arm 40R, the variable valve operating device 1 changes the coordination destination for the lifting motion of the second valve 16R from the variable valve mechanism 20R to the fixed valve mechanism 30. On the contrary, when the arm coupling mechanism 72 uncouples the great lift arm 70 from the second swing cam arm 40R, the variable valve operating device 1 changes the coordination destination for the lifting motion of the second valve 16R from the fixed valve mechanism 30 to the variable valve mechanism 20R. These changes correspond to switching between the dual and single valve variable control modes described below.

(Dual Valve Variable Control Mode)

Figure 5:
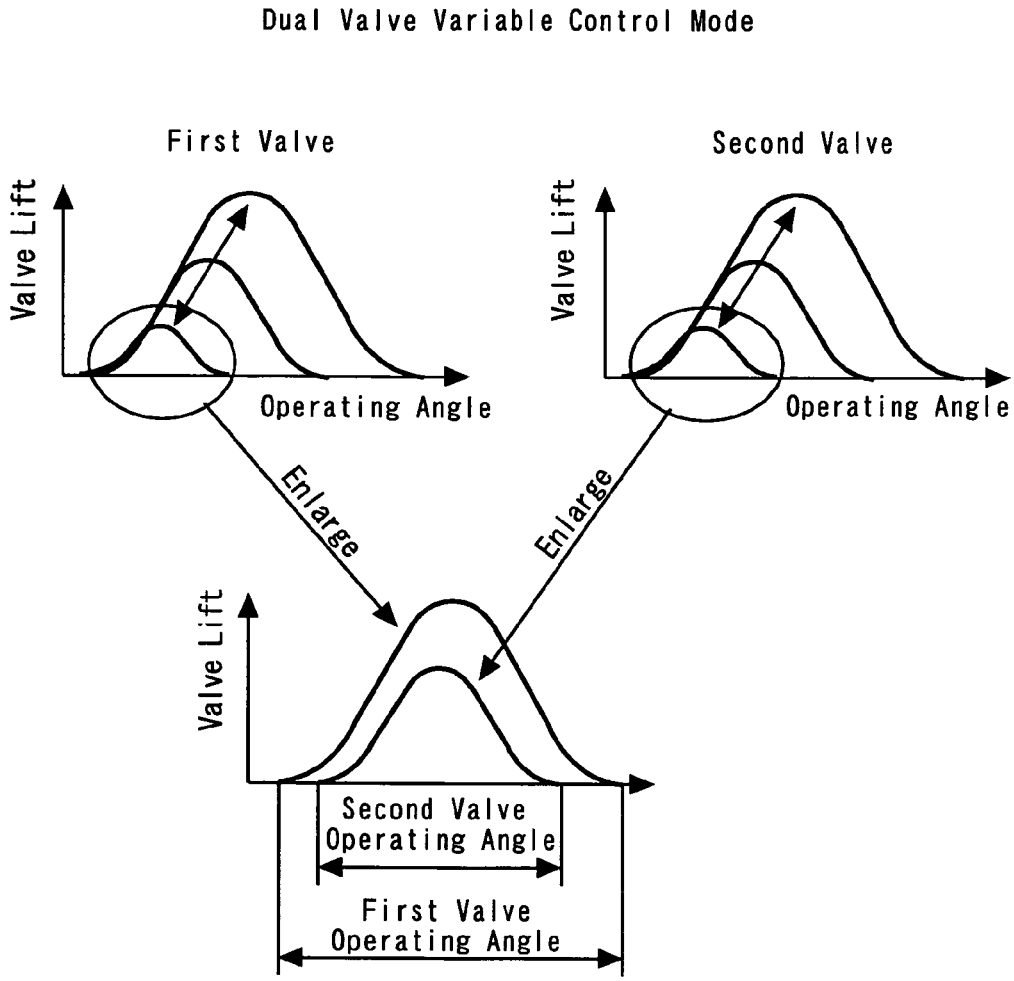
FIG. 5 is a set of lift diagrams that illustrate a first valve and a second valve in a situation where the great lift arm is not coupled to the second swing cam arm.

FIG. 5 is a set of lift diagrams that illustrate the first and second valves 16L, 16R in a situation where the great lift arm 70 is not coupled to the second swing cam arm 40R. In this situation, the rotary motion of the camshaft 10 is transmitted from the first drive cam 12 to the slide surfaces 50 of the first and second swing cam arms 40L, 40R via the first and second rollers 42, 44. In this instance, therefore, the dual valve variable control mode prevails, as indicated by the upper half of FIG. 5, so that the valve opening amounts (operating angles and lift amounts) of both the first and second valves 16L, 16R simultaneously change in accordance with changes in the angle of the control shaft 34.

(Single Valve Variable Control Mode)

Figure 6:
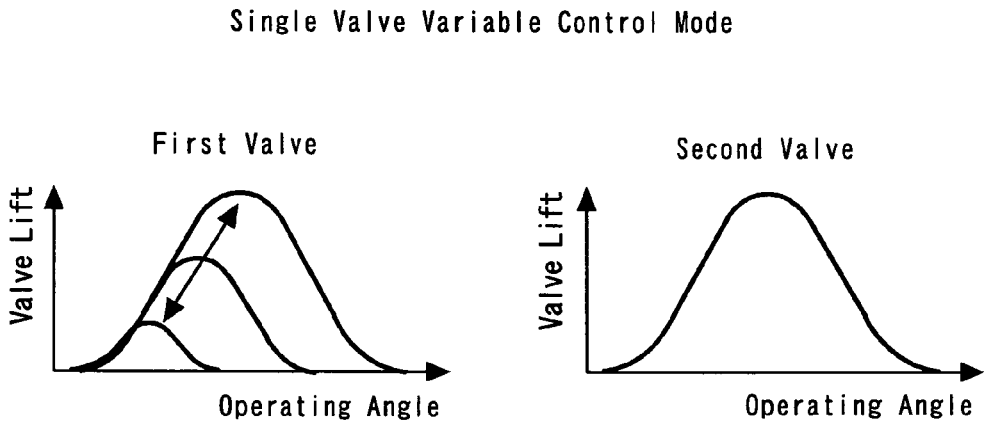
FIG. 6 is a set of lift diagrams that illustrate the first valve and the second valve in a situation where the great lift arm is coupled to the second swing cam arm.

FIG. 6 is a set of lift diagrams that illustrate the first and second valves 16L, 16R in a situation where the great lift arm 70 is coupled to the second swing cam arm 40R. In this situation, the rotary motion of the camshaft 10 is transmitted from the second drive cam 14 to the second swing cam arm 40R via the great lift arm 70. Therefore, the valve opening amount of the second valve 16R is constantly large without regard to the angle of the control shaft 34. On the other hand, the valve opening amount of the first valve 16L continuously varies in accordance with the angle of the control shaft 34 as is the case with the dual valve variable control mode. In other words, the single valve variable control mode prevails in this instance so that only the valve opening amount of the first valve 16L continuously varies in accordance with the variation of the angle of the control shaft 34 whereas the valve opening amount of the second valve 16R remains large, as shown in FIG. 6.

In a spark-ignition internal combustion engine, the amount of in-cylinder air is generally controlled by adjusting the opening of a throttle valve in an intake path. An internal combustion engine having the variable valve operating device 1 described above, however, can conduct a so-called non-throttle operation in which the amount of in-cylinder air is controlled by adjusting the opening of the valve 16 without using the throttle valve. When a non-throttle operation is performed, the throttle valve suffers no throttle loss. Since this reduces a pumping loss, the efficiency of the internal combustion engine increases. It means that the amount of fuel consumption can be decreased by performing a non-throttle operation.

In the single valve variable control mode, the variable valve operating device 1 can make the valve opening amount of the first valve 16L different from that of the second valve 16R. This creates an imbalance between the amount of air flow from the first valve 16L and the amount of air flow from the second valve 16R, and forms an in-cylinder swirl flow in accordance with the imbalance. The swirl flow provides combustion improvement in a low engine speed/low load region. When the valve opening amount of the first valve 16L is changed in this instance, its difference from the valve opening amount of the second valve 16R changes. This also changes the degree of imbalance between the amounts of air flow from the first and second valves 16L, 16R. Consequently, the strength of the swirl flow can be controlled by adjusting the valve opening amount of the first valve 16L.

Features of First Embodiment

As indicated by the lower half of FIG. 5, the variable valve operating device 1 according to the present embodiment ensures that the valve opening amount of the first valve 16L is larger than that of the second valve 16R when the valve opening amounts are minimized in the dual valve variable control mode. This provides the following advantages.

When the valve opening amounts are small in the dual valve variable control mode, a small amount of air flows through the second valve 16R, which has a smaller valve opening than the first valve 16L. Therefore, the air mainly flows through the first valve 16L and enters a cylinder. In this instance, the amount of in-cylinder air is mainly governed by the valve opening amount of the first valve 16L.

The strength of the swirl flow in the single valve variable control mode is determined by the difference between the rate of air flow in the first valve 16L and the rate of air flow in the second valve 16R. In this instance, the valve opening amount of the second valve 16R remains large so that a large amount of air flows in the second valve 16R. Therefore, a slight difference in the valve opening amount of the second valve 16R would not significantly affect the rate of air flow in the second valve 16R. On the other hand, the rate of air flow in the first valve 16L whose valve opening amount is decreased by the variable valve mechanism 20 would be greatly affected by a small change in the valve opening amount of the first valve 16L. Therefore, the difference between the rate of air flow in the first vale 16L and the rate of air flow in the second valve 16R is mainly governed by the valve opening amount of the first valve 16L. Consequently, the strength of the swirl flow in the single valve variable control mode is mainly governed by the valve opening amount of the first valve 16L.

In the present embodiment, the valve opening amount of the first valve 16L governs both the amount of in-cylinder air for a small valve opening in the dual valve variable control mode and the strength of the swirl flow in the single valve variable control mode, as described above. Therefore, when the valve opening amount of the first valve 16L is controlled, internal combustion engine torque and in-cylinder combustion status can be accurately controlled with ease no matter whether the dual or single valve variable control mode is selected.

Further, when the valve opening amounts of the first valves 16L for all cylinders are equalized, it is possible to avoid a cylinder-to-cylinder variation in combustion status and generated torque no matter whether the dual or single valve variable control mode is selected. This makes it possible to effectively reduce the occurrence of an internal combustion engine torque variation.

If, on the contrary to the present invention, the valve opening amount of the second valve 16R is larger than that of the first valve 16L when the valve opening amounts are minimized in the dual valve variable control mode, the advantages described above are not obtained. In this instance, the strength of the swirl flow in the single valve variable control mode is still governed mainly by the first valve 16L; however, the amount of in-cylinder air for a small valve opening in the dual valve variable control mode is governed mainly by the second valve 16R whose valve opening amount is large.

In other words, if the valve opening amount of the second valve 16R is larger than that of the first valve 16L when the valve opening amounts are minimized in the dual valve variable control mode, the amount of in-cylinder air or the strength of the swirl flow are governed mainly by the valve opening amount of the second valve 16R in the dual valve variable control mode and governed mainly by the valve opening amount of the first valve 16L in the single valve variable control mode. Due to such inconsistency, when the valve opening amount of the first valve 16L is controlled, in the dual valve variable control mode, accurate control does not result. And when the valve opening amount of the second valve 16R is controlled, in the single valve variable control mode, accurate control does not result. Further, even if the valve opening amounts of the first and second valves 16L, 16R for all cylinders are equalized during the use of a multi-cylinder internal combustion engine, it is impossible to avoid a cylinder-to-cylinder variation in in-cylinder air amount or swirl flow strength in either the dual valve variable control mode or single valve variable control mode. As a result, cylinder-to-cylinder torque variation occurs so that torque variation is likely to occur in the internal combustion engine.

On the other hand, the present invention does not cause the above inconvenience and makes it possible to accurately control the in-cylinder air amount and swirl flow strength in both the dual valve variable control mode and single valve variable control mode and provide accurate control over the torque of each cylinder. Consequently, cylinder-to-cylinder torque variation can be effectively suppressed.

The present invention does not particularly specify a method for making the valve opening amount of the first valve 16L larger than that of the second valve 16R in the dual valve variable control mode. However, the use of the following design methods will easily achieve the purpose at low cost.

One method is to use tolerance variations in the component parts of the variable valve mechanism 20. In general, an error occurs in the valve opening amount due to dimensional tolerance variations in the component parts of a valve mechanism. Therefore, different valve opening amounts can be intentionally provided by setting different dimensional tolerance ranges for a part that transmits the pushing force of the drive cam 12 to the first valve 16L and a part that transmits the pushing force of the drive cam 12 to the second valve 16R. For example, the valve opening amount of the second valve 16R can be made smaller than that of the first valve 16L in the dual valve variable control mode by making the diameter tolerance of the second roller 44R for the second valve 16R smaller than that of the second roller 44L for the first valve 16L. The use of this method eliminates the necessity of changing the tolerance widths (tolerance ranges) of both parts and achieves the purpose simply by shifting a range. Consequently, the parts can be manufactured at low cost because high machining accuracy is not required.

Another method is to make the swing cam surface 52L of the first swing cam arm 40L different in profile from the swing cam surface 52R of the second swing cam arm 40R. More specifically, the valve opening amount of the second valve 16R can be made smaller than that of the first valve 16L when the swing cam surface 52R of the second swing cam arm 40R has the same profile as the swing cam surface 52L of the first swing cam arm 40L with the phase relative to the swing center shifted toward a small valve opening side (rotated counterclockwise in FIG. 2). In this instance, the profile of swing cam surface 52R has the same shape as the profile of swing cam surface 52L although they differ in phase. Therefore, machining can be accomplished with ease so that the manufacturing cost is low.

As mentioned earlier, the valve opening amounts of assembled valve mechanisms generally vary (deviate from target design values) due, for instance, to component parts machining accuracy and assembling accuracy. In view of such circumstances, the variable valve operating device 1 according to the present embodiment includes an adjustment mechanism 86 (see FIG. 1), which adjusts (fine tunes) the valve opening amounts of the first and second valves 16L, 16R. It should be noted in this connection that the adjustment mechanism 86 is excluded from FIGS. 2 and 3.

Figure 7:
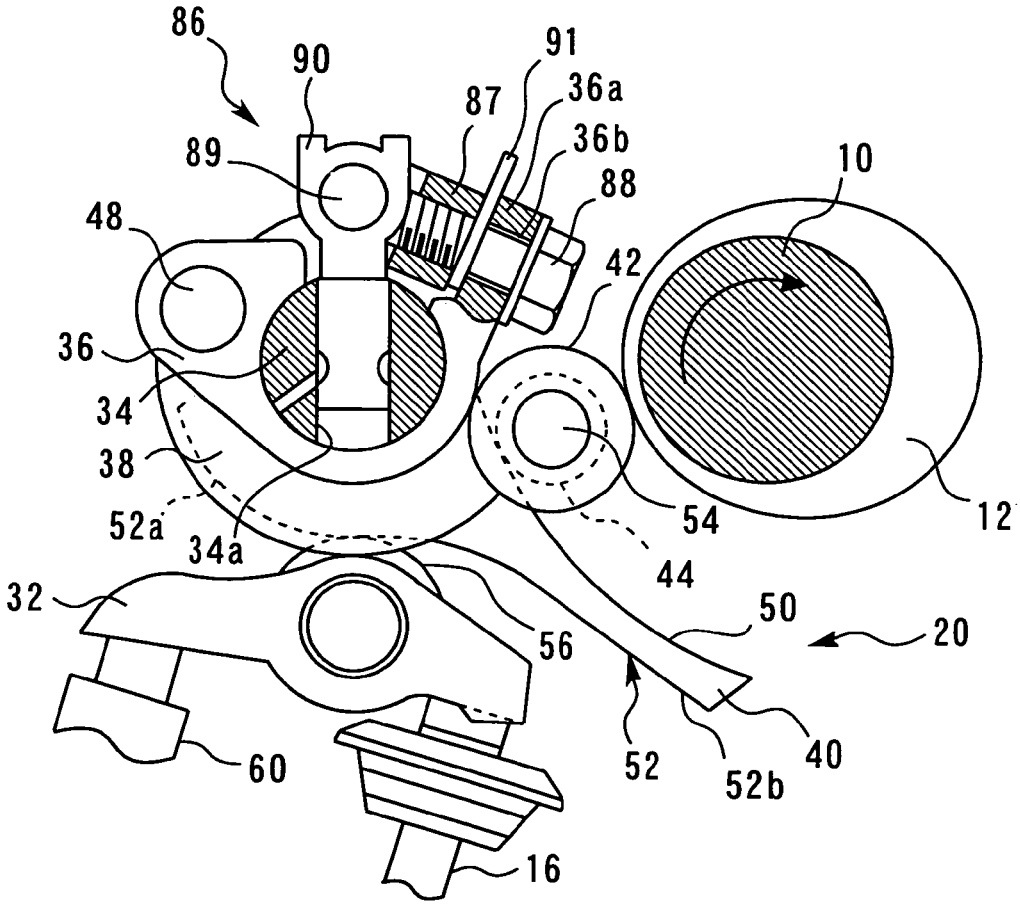
FIG. 7 is a side view illustrating the configuration of an adjustment mechanism according to the first embodiment of the present invention.

FIG. 7 is a side view illustrating the configuration of the adjustment mechanism 86. The adjustment mechanism 86 will now be described with reference to FIG. 7. The adjustment mechanism 86 includes a universal link 87, which is pivotally coupled to the control shaft 34. A screw hole is provided in the universal link 87. A lock bolt 88 is screwed into this screw hole. The universal link 87 can pivot on a pin 89 that is positioned in parallel with the control shaft 34. A hole 34*a* is made in the control shaft 34. A pin support member 90 is press-fit into this hole 34*a*. The pin support member 90 projects laterally from the control shaft 34. The pin 89 is fastened to the control shaft 34 as it is inserted into a hole made in the projection of the pin support member 90.

A projection 36*a* is formed on the control arm 36. The lock bolt 88 is inserted into an elongated hole 36*b* made in the projection 36*a*. A plate-like adjustment shim 91 is inserted between the projection 36*a* and the end face of the universal link 87. A C-shaped cut is made in the adjustment shim 91 and used to position the adjustment shim 91 across the lock bolt 88. The adjustment shim 91 is secured by the force that is applied to tighten the lock bolt 88. The adjustment shim 91 can be removed by loosening the lock bolt 88.

Since a plurality of adjustment shims 91, which vary in thickness, are prepared, the installed adjustment shim 91 can be replaced with another one having different thickness. The valve opening amount of the valve 16 can be adjusted by replacing the installed adjustment shim 91 with another one having different thickness. If, for instance, the installed adjustment shim 91 is replaced with a thinner one, the distance between the projection 36*a* and the end face of the universal link 87 decreases. The mounting angle of the control arm 36 relative to the control shaft 34 is then displaced counterclockwise in FIG. 7. When the mounting angle of the control arm 36 is displaced in such a direction, the second roller 44 is displaced toward the leading end of the swing cam arm 40. The direction of this displacement is the direction of reducing the valve opening amount of the valve 16. As described above, the valve opening amount of the valve 16 can be decreased by using a thinner adjustment shim 91 or increased by using a thicker adjustment shim 91.

The present embodiment includes a pivotable universal link 87 and uses an elongated hole 36*b* as the bolt hole for the projection 36*a*. Therefore, even when the installed adjustment shim 91 is replaced with another one having different thickness, planar contact is maintained between the end face of the universal link 87, the adjustment shim 91, and the projection 36*a*. Therefore, the lock bolt 88, which fastens the control arm 36 to the control shaft 34, does not readily loosen without regard to the thickness of the adjustment shim 91.

Figure 8:
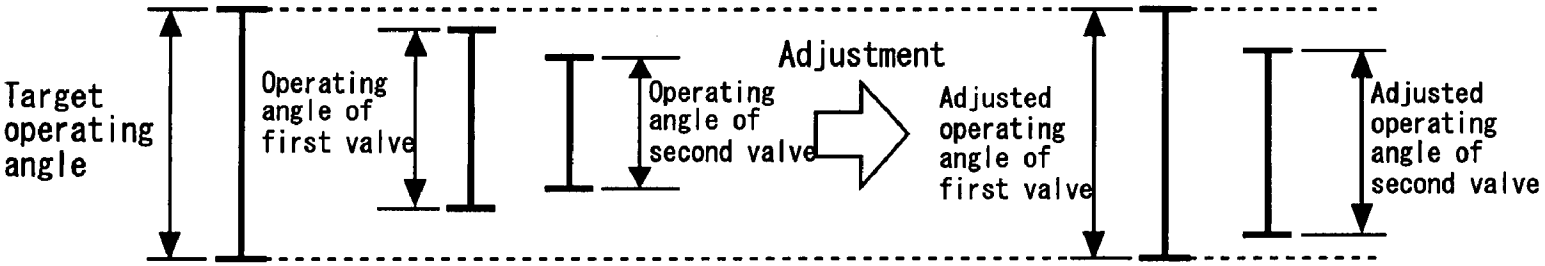
FIG. 8 illustrates how the operating angles of the first and second valves change when the adjustment mechanism makes valve opening amount adjustments.

FIG. 8 illustrates how the operating angles of the first and second valves 16L, 16R change when the adjustment mechanism 86 makes valve opening amount adjustments. As described earlier, the second roller 44L for the first valve 16L and the second roller 44R for the second valve 16R are supported by the same link arm 38. Therefore, adjustments made by the adjustment mechanism 86 affect the valve opening amounts of both the first valve 16L and the second valve 16R. It means that the adjustment mechanism 86 simultaneously adjusts the valve opening amounts of the first and second valves 16L, 16R while maintaining their ratio. Here, the valve opening amount of the second valve 16R is the valve opening amount prevailing in the dual valve variable control mode.

As described earlier, the present embodiment ensures that the valve opening amount of the first valve 16L is larger than that of the second valve 16R in the dual valve variable control mode. Further, the in-cylinder air amount and swirl flow strength are mainly governed by the valve opening amount of the first valve 16L in both the dual and single valve variable control modes. Therefore, it is preferred that the adjustment mechanism 86 make valve opening amount adjustments with reference to the first valve 16L while adjusting the valve opening amount of the first valve 16L for a target design value.

FIG. 8 shows a case where the operating angle of the first valve 16L is smaller than a target operating angle before adjustments. In this case, the adjustment shim 91 can be replaced with a thicker one to increase the operating angle of the first valve 16L until it agrees with the target operating angle. When this adjustment is made, the operating angle of the second valve 16R also increases at the same ratio as for the operating angle of the first valve 16L. As described above, the adjustment mechanism 86 can simultaneously adjust the valve opening amounts of the first and second valves 16L, 16R while maintaining their magnitude relationship. This eliminates the necessity of separately adjusting the valve opening amounts of the first and second valves 16L, 16R, thereby reducing the time required for adjustments.

In the single valve variable control mode, the valve opening amount of the second valve 16R is absolutely large. Therefore, a slight error would not significantly affect the amount of air. Consequently, no problem occurs even if the valve opening amount of the second valve 16R is not fine tuned in the single valve variable control mode.

When a multi-cylinder internal combustion engine having the variable valve operating device 1 that includes the adjustment mechanism 86 described above is to be assembled, valve opening amount adjustments are made for each cylinder. The valve opening amount adjustments are made by measuring the valve opening amount of the first valve 16L while replacing, as needed, the adjustment shim 91 with another one having different thickness, and selecting an adjustment shim 91 that causes the measured value to agree with a target value. In such an instance, it is important to determine what valve opening amount of the first valve 16L, which is variable, should be used for adjustment purposes.

As regards the present invention, it is preferred that valve opening amount adjustments be made while the control shaft 34 is rotated fully counterclockwise as shown in FIG. 3 to minimize the valve opening amount of the first valve 16L. As mentioned earlier, an error in the valve opening mount greatly affects the rate of air flow through the valve when the valve opening amount is small, and slightly affects the rate of air flow through the valve when the valve opening amount is large. Therefore, the in-cylinder air amount and swirl flow strength can be precisely controlled because the air flow rate prevailing when the valve opening amount is small can be controlled with increased accuracy by adjusting the valve opening amount of the first valve 16L for a target value while the valve opening amount is minimized.

When the valve opening amounts are adjusted as described above for all cylinders, the minimum valve opening amounts of the first valves 16L for all cylinders are equal. As mentioned earlier, the in-cylinder air amount and swirl flow strength are mainly governed by the valve opening amounts of the first valves 16L no matter whether the dual or single valve variable control mode is selected. Therefore, when the valve opening amounts of the first valves 16L for all cylinders are equalized, cylinder-to-cylinder variation in torque and combustion status can be avoided to effectively avert torque variation and other problems.

Further, the present embodiment can eliminate the necessity of making adjustments to equalize the valve opening amounts of the second valves 16R for all cylinders, as described earlier. It means that the valve opening amount adjustments can be simplified for cost reduction.

Furthermore, when there are a plurality of cylinders, it is preferred that the minimum valve opening amounts of the first valves 16L for all cylinders be equalized as mentioned earlier. Therefore, when the valve opening amounts of the valves 16 for all cylinders of a multi-cylinder internal combustion engine having the variable vale train 1 are to be subjected to learning control, it is preferred that the first valves 16L be equipped with a lift sensor or the like to measure the minimum valve opening amounts of the first valves 16L for all cylinders and exercise control to equalize the measured values of all cylinders. This provides the aforementioned advantages.

The first embodiment, which has been described above, assumes that the first and second valves 16L, 16R are intake valves. However, the present invention may also be applied to exhaust valves.

The valve opening amount difference shown in the lower half of FIG. 5 is exaggerated. It does not indicate an actual valve opening amount difference.

The first embodiment, which has been described above, assumes that the valve mechanism continuously varies the valve opening amounts of the first and second valves 16L, 16R (in the dual valve variable control mode) or the valve opening amount of the first valve 16L (in the single valve variable control mode). However, the present invention can also be applied to a valve mechanism that varies the valve opening amounts in multiple steps.

The first embodiment, which has been described above, assumes that the valve mechanism can switch between the dual valve variable control mode and single valve variable control mode. However, the present invention can also be applied to a valve mechanism that constantly operates in the dual valve variable control mode.

In the first embodiment, which has been described above, the variable valve mechanisms 20L, 20R and fixed valve mechanism 30 correspond to the "valve mechanism" according to the first and fifth aspects of the present invention, and the second rollers 44L, 44R correspond to the "first and second transmission members" according to the seventh aspect of the present invention.

The invention claimed is:

1. A variable valve operating device comprising:

a valve mechanism that can select a dual valve variable control mode in which the valve opening amounts of a first valve and a second valve can be varied continuously or in multiple steps, the first and the second valve being of the same type and provided for each cylinder in a multi-cylinder internal combustion engine, wherein a valve opening amount difference is provided so that the valve opening amount of the first valve for each cylinder is larger than the valve opening amount of the second valve when the valve opening amounts are minimized in the dual valve variable control mode; and wherein adjustments are made so that the minimum valve opening amount of the first valve does not vary from one cylinder to another.

2. The variable valve operating device according to claim 1, wherein the second valve is not adjusted to provide the same valve opening amount for all cylinders.

3. The variable valve operating device according to claim 1, wherein the valve mechanism can switch between the dual valve variable control mode and a single valve variable control mode in which the valve opening amount of the first valve can be varied continuously or in multiple steps while the valve opening amount of the second valve is fixed at a predetermined value.

4. The variable valve operating device according to claim 1, further comprising:

an adjustment mechanism for simultaneously adjusting the valve opening amounts of the first valve and the second valve in the dual valve variable control mode, wherein the adjustment mechanism makes adjustments so that the minimum valve opening amount of the first valve does not vary from one cylinder to another.

5. A variable valve operating device comprising:

a valve mechanism that can switch between a dual valve variable control mode in which the valve opening amounts of a first valve and a second valve, which are of the same type and provided for the same cylinder, can be varied continuously or in multiple steps, and a single valve variable control mode in which the valve opening amount of the first valve can be varied continuously or in multiple steps while the valve opening amount of the second valve is fixed at a predetermined value, wherein a valve opening amount, difference is provided so that the valve opening amount of the first valve is larger than the valve opening amount of the second valve when the valve opening amounts are minimized in the dual valve variable control mode; and wherein the fixed valve opening amount of the second valve in the single valve variable control mode is larger than the valve opening amount of the first valve.

6. The variable valve operating device according to claim 5, further comprising:

a first swing cam arm that swings in synchronism with camshaft rotation and has a cam surface for pressing the first valve directly or indirectly; and a second swing cam arm that swings in synchronism with camshaft rotation and has a cam surface for pressing the second valve directly or indirectly;

wherein the valve opening amount difference is provided by shifting the phase of the cam surface profile of the second swing cam arm toward a small valve opening side while allowing the cam surface profile of the second swing cam arm to have the same shape as the cam surface profile of the first swing cam arm.

7. The variable valve operating device according to claim 5, further comprising:

a pushing force transmission mechanism having a first transmission member and a second transmission member, which transmit a cam's pushing force to the first valve and the second valve, respectively, wherein the valve opening amount difference is provided by shifting the range of dimensional tolerance of the second transmission member toward the small valve opening side while allowing the second transmission member to have the same dimensional tolerance width as the first transmission member.

8. The variable valve operating device according to claim 5, further comprising:

an adjustment mechanism for simultaneously adjusting the valve opening amounts of the first valve and the second valve in the dual valve variable control mode while maintaining the ratio between the valve opening amounts of the first and second valves.

9. A valve opening amount adjustment method for adjusting the valve opening amounts of valves in a multi-cylinder internal combustion engine having the variable valve operating device according to claim 5, the valve opening amount adjustment method comprising the step of:

adjusting the valve opening amounts of cylinders so that the minimum valve opening amount of the first valve does not vary from one cylinder to another.

* * * * *